US006743042B2

(12) United States Patent
Kölle et al.

(10) Patent No.: US 6,743,042 B2
(45) Date of Patent: Jun. 1, 2004

(54) PIERCING CONTACT CLIP

(75) Inventors: Bernd Kölle, Brackenheim (DE); Jürgen Gutekunst, Nürtingen (DE); Bernhard Eigen, Weissach im Tal (DE)

(73) Assignee: Murr-Elektronik Gesellschaft mit beschränkter Haftung, Oppenweiler (DE)

( * ) Notice: Subject to any disclaimer, the term of this patent is extended or adjusted under 35 U.S.C. 154(b) by 0 days.

(21) Appl. No.: 10/249,504

(22) Filed: Apr. 15, 2003

(65) Prior Publication Data

US 2004/0002250 A1 Jan. 1, 2004

(30) Foreign Application Priority Data

Apr. 15, 2002 (EP) ..... 02008482

(51) Int. Cl.[7] ..... H01R 11/20
(52) U.S. Cl. ..... 439/417; 439/425
(58) Field of Search ..... 439/417, 422, 439/425, 426, 408, 409

(56) References Cited

U.S. PATENT DOCUMENTS 3,874,762 A 4/1975 Shott et al.
5,704,801 A * 1/1998 Walker et al. ..... 439/417
5,722,852 A * 3/1998 Miek ..... 439/417
6,383,013 B1 * 5/2002 Ghesla et al. ..... 439/417
6,648,672 B1 * 11/2003 Meinke ..... 439/422

FOREIGN PATENT DOCUMENTS

EP 0 726 623 8/1996
WO 94/24728 10/1994

* cited by examiner

*Primary Examiner*—Tho D. Ta
*Assistant Examiner*—James R. Harvey
(74) *Attorney, Agent, or Firm*—Gudrun E. Huckett

(57) ABSTRACT

A contact clip for an insulated, multi-strand electric cable has first and second clip parts engaging one another. The first clip part has a receptacle for correctly positioning the cable and the second clip part has contact pins assigned to a strand of the cable, respectively. The contact pins pierce the cable insulation and electrically contact the strands of the cable. They are positioned transversely to a longitudinal cable direction adjacent to and at a spacing from one another. This spacing matches the strand spacing. The receptacle is wider than the cable in the transverse cable direction. A fitting member is inserted into the receptacle for determining a lateral position of the cable in the receptacle. A first contact pin, depending on the lateral position of the cable within the receptacle, either engages one of the strands of the cable or the fitting member.

11 Claims, 4 Drawing Sheets

PIERCING CONTACT CLIP

BACKGROUND OF INVENTION

1. Field of the Invention

The invention relates to a contact clip for an insulated, multi-strand electric cable, in particular, a shape-coded shaped cable, comprised of two clip parts engaging one another, wherein one clip part has a receptacle for the position-correct placement of the cable and the other clip part has at least one contact pin correlated with one strand of the cable, respectively, which in the mounted state of the clip parts, pierces the insulation of the cable and is positioned electrically contacting within the strand of the cable in the pierced position, wherein the contact pins are positioned transversely to the longitudinal direction of the cable adjacent to and at a spacing from one another which spacing corresponds approximately to the spacing of the strands.

2. Description of the Related Art

Shape-coded shaped cables are used as bus cables or energy-supply cables in machine controls in order to connect actuating devices (solenoid valves and the like) and sensors with an interface. These shaped cables must withstand high mechanical loading and must be resistant against soiling, acids, solvents and the like so that a correspondingly resistant insulation is selected. The shaped cables, which are usually configured as flat cables, are difficult to contact because of their resistant insulation so that piercing is employed. Accoridng to this piercing technology, the shaped cable is pressed onto contact blades which cut through the insulation and penetrate into the copper core of the cable strands in order to produce electrical contacting. This requires that a terminal-correct contacting be realized in order to ensure proper electrical function. In practice, it was found that when installing shaped cables the cables are often introduced into the piercing connector in a reversed position. In order to provide a position-correct insertion of the cable, it was therefore necessary to provide additional loops; this is cumbersome, uses up installation space, and greatly impedes a search for errors.

SUMMARY OF INVENTION

It is an object of the present invention to provide a piercing contact clip which ensures, independent of the position of the cable to be connected, a terminal-correct connection, i.e., the proper terminals are connected with one another.

In accordance with the present invention, this is achieved in that the receptacle is configured to be wider than the cable in a direction transversely to the longitudinal direction of the cable, in that a fitting member is inserted into the receptacle which determines the lateral position of the cable in the receptacle, and in that in the other clip part an additional contact pin is provided which is located transversely to the longitudinal direction of the cable at a spacing, corresponding approximately to the spacing between the strands, to the neighboring contact pin, and, depending on the lateral position of the cable within the receptacle, either engages the strand of the cable or engages the fitting member.

It is important in this connection that the receptacle is wider transversely to the longitudinal direction of the cable than the cable itself in order to be able to change the lateral positioning of the cable in the receptacle depending on the position of the incoming cable. For this purpose, a fitting member is provided which, as a function of the position of the incoming cable, is arranged either at one or the other lateral edge of the receptacle so that the cable can be displaced by the width of the fitting member transversely to the longitudinal direction of the cable. In accordance with the displacement of the cable in the receptacle, the other clip part is provided with an additional contact pin which is positioned in a direction transversely to the longitudinal direction of the cable at a spacing, corresponding approximately to the spacing of the strands, relative to the neighboring contact pin so that depending on the lateral position of the cable in the receptacle this contact pin engages either one strand of the cable or the fitting member.

Depending on the position of the incoming cable, either one or the other outer contact pin are used for contacting the strand in the incoming cable, wherein the contact pin not contacting the strand dead-ends.

Preferably, the arrangement is such that a central row of contacts is positioned in a plane which symmetrically divides the receptacle in the longitudinal direction of the cable. The positional change of the cable within the receptacle corresponds thus always to the spacing of the strands of the cable relative to the center, wherein the central row of contacts in this way always contacts the same strand in the receptacle independent of the position of the cable.

Preferably, the cable is a dual-strand cable having correlated therewith three contact pins arranged transversely to the longitudinal direction of the cable adjacent to one another. The cable is then positioned in a first position at a first lateral edge of the receptacle and in the other position at the second lateral edge of the receptacle so that the cable can be positioned in a first position and a second position that are rotated by 180 degrees relative to one another about the central contact pin.

The contact pins are preferably contact blades having a cutting blade aligned approximately in the longitudinal direction of the cable and centrally cutting into the core of the cable strand.

In order to ensure, independent of the position of the cable in the receptacle, a terminal-correct connection of the contact clip, the outer contact pins are connected electrically with one another.

In order to also satisfy the strict requirements of upper-level safety classes, it is preferably provided that the fitting member is embodied as a sealing device so that the fitting member surrounds expediently, preferably completely, the cable. The fitting member itself thus forms a seal surrounding the cable so that the contact area of the piercing blade is properly sealed against the environment.

The shaped cable can extend through the contact clip wherein the contact clip itself is an electrical connector between the end pieces of the shaped cables or of cables that extend adjacent and parallel to one another. Also, the contact clip according to the invention can be provided with a plug connector for which purpose, for example, the plug connector is arranged on one or the other clip part. Preferably, the plug connector or the like is provided on the clip part which also supports the contact pins (contact blades).

DETAILED DESCRIPTION

Figure 1:
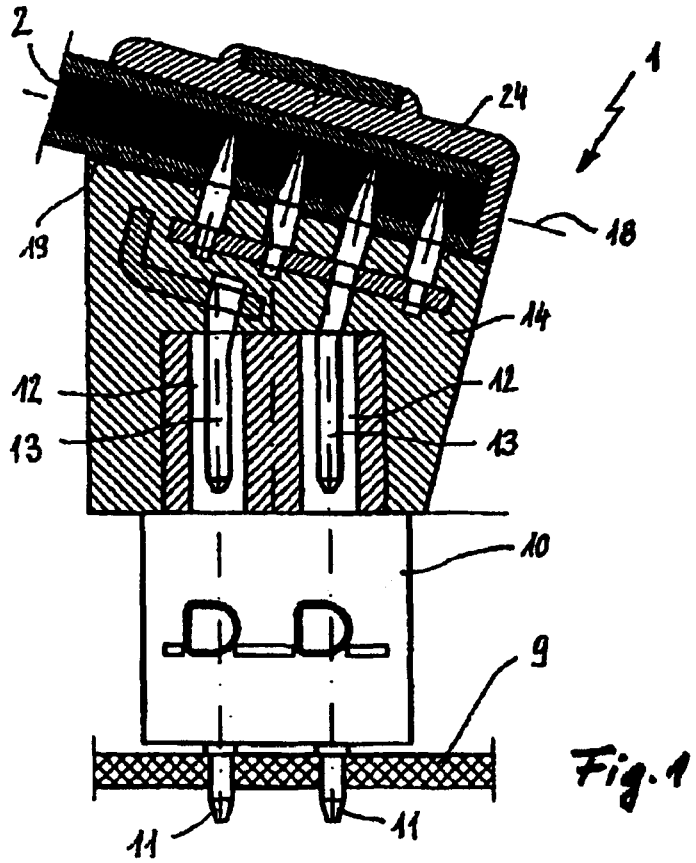
FIG. 1 is a sectional view of a piercing contact clip for a shape-coded shaped cable.
Figure 3:
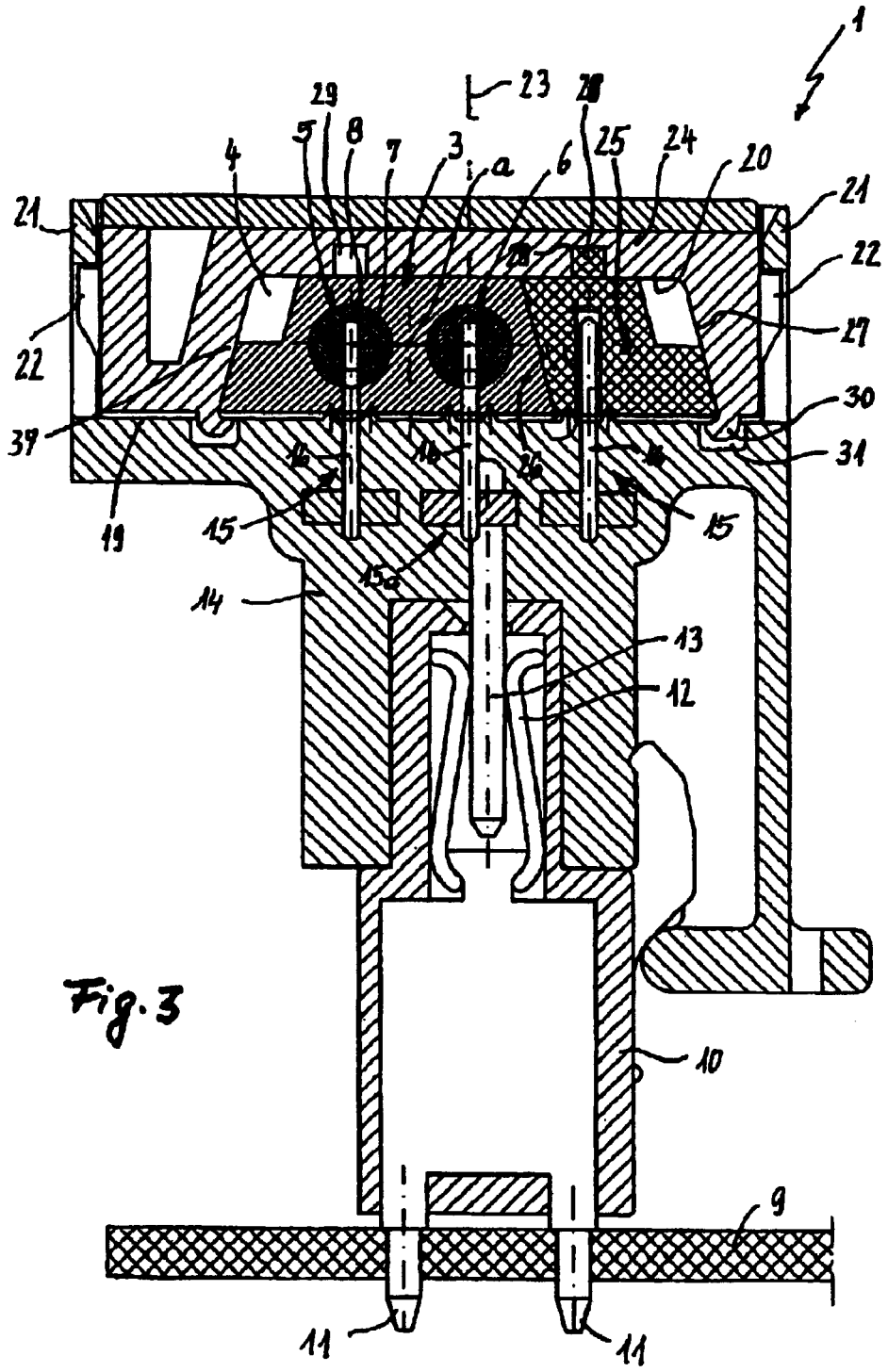
FIG. 3 is a cross-sectional view of the contact clip according to FIG. 1.

The piercing contact clip illustrated in FIG. 1 serves for connecting an insulated, multi-strand electric cable 2 which in the illustrated embodiment is a shape-coded shaped cable 3 illustrated in FIG. 3 in cross-section. The shaped cable 3 has a substantially trapezoidally cross-section with a cutout provided at the corner 4 (FIG. 3). Within this shaped cable 3, which is made of soft-elastic material but can also be made of harder plastic material, several strands 5, 6 of an electric conductor are provided. In the shown embodiment, within the shaped cable 3 there are three strands 5, 6 comprised preferably of a core 7 made of copper and a round insulation 8.

The piercing contact clip 1 serves for connecting the cable 2 to an electrical control unit, an interface or the like. In the illustrated embodiment, the electrical contact clip is secured on a printed circuit board 9. For this purpose, the contact clip 1 has a leg 10 provided on one side with two soldered contacts 11 with which the leg 10 is electrically conductingly secured on the printed circuit board 9. On the side facing away from the printed circuit board 9, the leg 10 is provided with two plug sockets 12 which are engaged by plug-in contacts 13 of the bottom part 14 of the contact clip 1. For this purpose, the bottom part 14 is configured as a plug-like base member which is secured, preferably positive-lockingly, on the leg of the contact clip 1.

Figure 2:
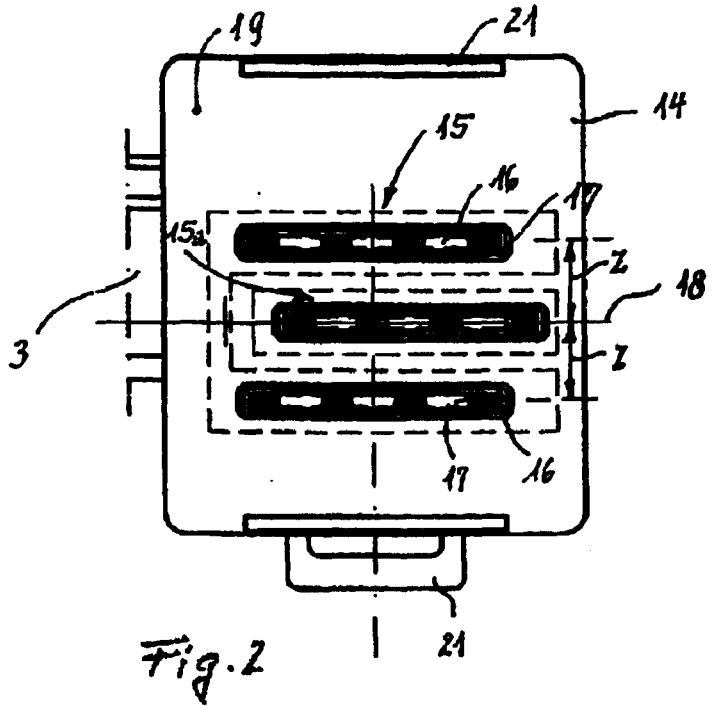
FIG. 2 is a plan view onto the bottom part of the contact clip provided with a contact blade.

As illustrated in FIG. 2, several contact pins 15, which are contact blades 16 in the illustrated embodiment, are provided in the bottom part 14 of the contact clip The cutting blade of a contact blade 16 is positioned so as to be aligned in the longitudinal direction 18 of the cable 3.

As illustrated in FIG. 1, the contact surface 19 of the bottom part 14 is positioned at an angle relative to the printed circuit board 9. This position is provided in order to enable the insertion of a plurality of electric cables by means of tightly adjacently positioned contact clips.

In the shown embodiment, a two-strand cable 3 is illustrated having arranged at least three adjacently positioned contact pins 15, 15*a* transversely to the longitudinal direction 18. In the illustrated embodiment, in the longitudinal direction 18 of the shaped cable 3 several contact pins 15 embodied as cutting blades 16 are provided. In the shown embodiment, three contact blades 16 are provided at identical spacing relative to one another sequentially in the longitudinal direction 18 of the shaped cable 3 in order to enable a high current load.

The center spacing z of the cutting blades 16 measured transversely to the longitudinal direction 18 corresponds approximately to the center spacing a of the cores 7 of the electric strands 5 and 6. In this way, by means of pressing the shaped cable 3 onto the blades, the shaped cable 3 positioned correctly relative to the contact blades 16 can be electrically contacted with the contact pins 15. In this connection, the contact blades 16 of the contact pins 15 penetrate the material of the shaped cable 3, cut through the round installation 8 of the strands 5 and 6, and penetrate into the electrical conducting core 7 of the strands 5, 6, respectively, so that an electrical contact between the respective strands 5, 6 and the penetrating contact pins 15, 15*a* is produced.

In order to ensure a position-correct arrangement of the shaped cable 3 relative to the contact pins 15, 15*a*, a receptacle 20 for the shaped cable 3 is formed within the top part 24 of the contact clip. In order to ensure upon combination of the bottom and top parts the position-correct alignment of the receptacle 20 relative to the rows of contact pins 15, 15*a*, the top part 24 of the contact clip 1 can be placed onto the bottom part 14 of the contact clip 1 only in an aligned position. For this purpose, the edge of the top part 24 has noses 22 which lock in the locking bracket 21 of the bottom part 14. As illustrated in particular in FIG. 2, the locking brackets 21 are designed differently so that the top part 24 can be snapped lockingly into place only in a position-correct alignment relative to the bottom part 14 of the contact clip 1.

Figure 5:
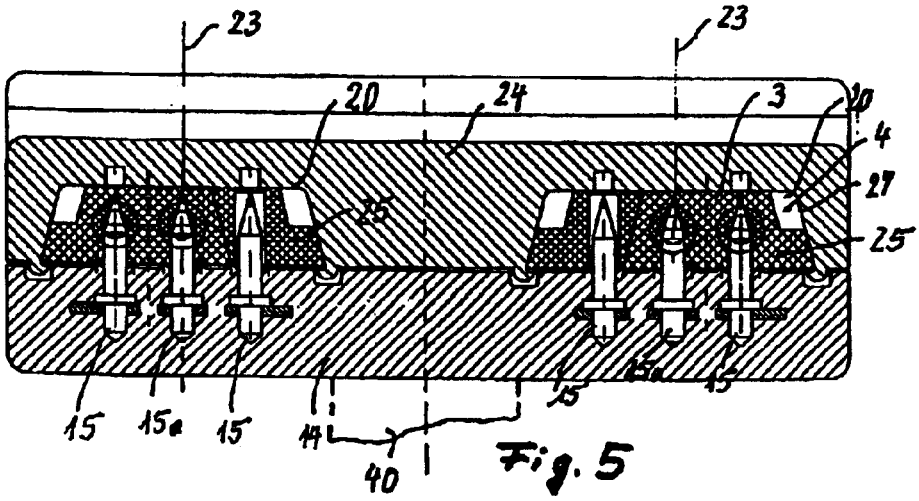
FIG. 5*a* sectional view along the line V—V of FIG. 4.

The contact blades 16 of the central contact row 15*a* (FIG. 2) are electrically connected with one another and connected to a common plug-in contact 13 which engages of plug socket 12 of the clip leg 10. The cutting blades 16 of the central contact row 15*a* are positioned, as illustrated in particular in FIG. 3 and FIG. 5, in a plane 23 which symmetrically divides the receptacle 20. The receptacle 20 is wider transversely to the longitudinal direction 18 of the shaped cable 3 than the cable. The receptacle 20 is approximately 1.5 times as wide as the shaped cable 3.

When placing the shaped cable 3 into the receptacle 20 attention must be paid that the base of the trapezoidal cross-section is positioned so as to face contact pins 15, 15*a*. In order to ensure a safe holding of the shaped cable 3 in the receptacle 20, the fitting member 25 is provided which fills the empty space between the lateral leg 26 and the lateral edge 27 of the receptacle 20. The arrangement is such that the shaped cable 3 is aligned in the receptacle 20 such that the strand 6 neighboring the lateral leg 26 is positioned with its center or its longitudinal center axis precisely in the plane 23 of the central contact row 15*a*.

In the illustrated embodiment of FIG. 3, the contact blades 16 of one outer contact row 15 penetrate the fitting member 25 while the cutting blades 16 of the other outer contact row 15 penetrate centrally into the core 7 of the second strand 5 of the shaped cable 3 and produce electrical contact. The two outer contact rows, as also shown in FIG. 2 in dashed lines, are electrically contacted with one another and are electrically connected by a common plug contact 13 (FIG. 1) to the second plug socket 12 of the clip leg 10. In order to provide a sufficient holding action of the shaped cable 3 in the receptacle 20 for mounting, it is provided that the fitting member 25 is clamped by a rib 28 in a groove 29 of the bottom of the receptacle 20 so that the fitting member 25 is securely held in place. The fitting member 25 is preferably elastic so that upon placement of the shaped cable a slight clamping action between the lateral leg 26 and the opposed lateral edge 37 of the receptacle 20 is achieved. Preferably, the receptacle 20 has a slightly inwardly projecting edge 30 which engages from below the edges of the fitting member 25 and the shaped cable 3. The edge 30 is positioned in a groove 31 provided in the contact surface 19 of the bottom part 14. Preferably, a sealing element can be arranged in the groove 31 so that a sealing action of the receptacle 20 to the exterior can be obtained; in this way, safety classes up to the level of IP67 (International Protection Rating) can be achieved.

As a result of the course of the shaped cable 3 at the installation location as well as the arrangement of the contact clip, it can occur that the shaped cable 3 arrives at a different spatial position and orientation at the contact clip. For example, a position of the shaped cable 3 rotated by 180 degrees relative to the central contact pin 15*a* is possible as illustrated on the right side of FIG. 5. In such a position of the shaped cable 3, the fitting member 25 is arranged in the receptacle 20 at the lateral edge 37 and its rib 28 is secured by a clamping action in the groove provided at the bottom of the receptacle 20. The alignment of the shaped cable 3 is such that the strand 6 neighboring the lateral leg 26 is contacted by the central contact row 15*a* while the strand 5 is now positioned at the other side of the central contact row 15*a*, i.e., is adjacent to the lateral edge 27 of the receptacle 20. The corner 4 which is cut out at the shaped cable 3 is now positioned at the lateral edge 27. Since the outer contact rows 15 are electrically connected with one another, the electrical terminal connection remains the same, i.e., despite a different position of the shaped cable 3 in the receptacle 20 a terminal-correct contacting is ensured by means of the contact blades 16 of the contact rows 15 and 15*a*.

The fitting member which is preferably embodied as a coding plate ensures the position-correct arrangement of the shaped cable 3 in the receptacle 20 in order to ensure an electrically correct, terminal-correct contacting independent of the position of the shaped cable 3. After insertion of the fitting member 25 into the receptacle, only a single predetermined position of the shaped cable 3 in the receptacle is possible. When the shaped cable 3 is arranged in a different orientation, the fitting member 25 must first be repositioned in order to enable the insertion of the shaped cable 3 in the receptacle 20. Depending on the position of the shaped cable 3, it then rests against one lateral edge 27 or the other lateral edge 37 of the receptacle 20.

Figure 4:
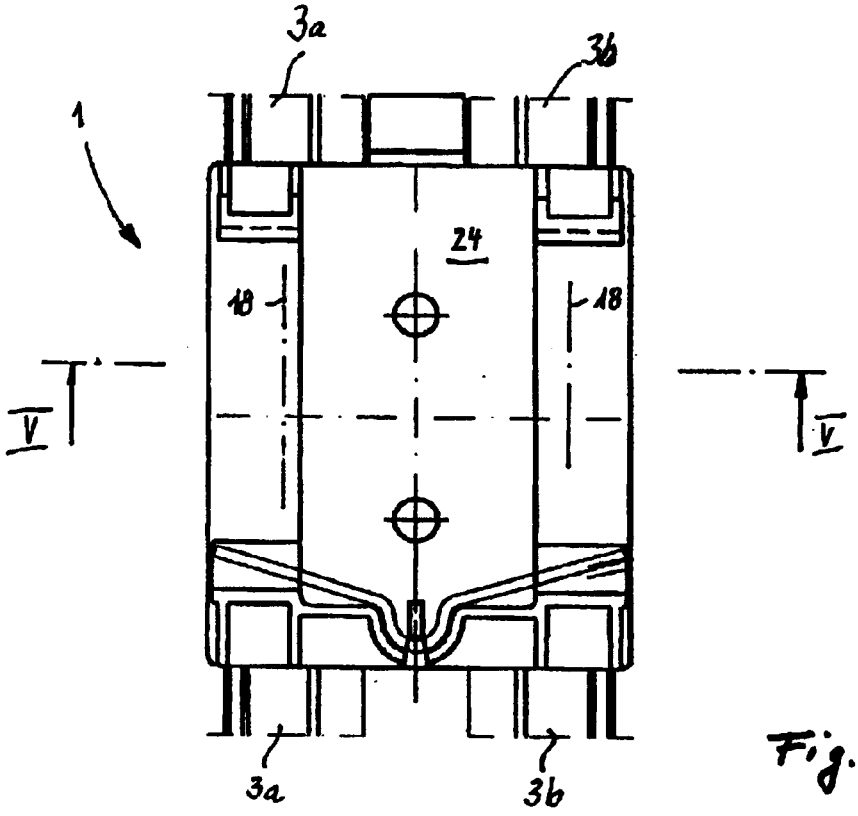
FIG. 4 is a plan view onto a contact clip for several shaped cables.

The contact clip 1 according to the invention is not only suitable for use at the end of a cable 2 but the cable can also extend through the contact clip 1. In the embodiment according to FIG. 4 and FIG. 5, the contact clip 1, for example, is provided for electrically contacting two shaped cables 3*a* and 3*b*. Corresponding to the embodiment described in connection with FIGS. 1 through 3, at one bottom part 14 rows of contact pins 15, 15*a* are provided wherein the central row 15*a* is positioned in a plane 23 which divides the receptacle 20 in the top part 24 symmetrically. The contact pins 15*a* form thus the central contact pins.

The receptacles 20 extend in the longitudinal direction 18 of the shaped cable 3*a*, 3*b* across the entire length of the top part 24 of the contact clip and are open at their ends, respectively. The shaped cables 3*a*, 3*b* extends through the receptacles and, by employing the fitting member 25, are secured position-correctly in the receptacles 20. The central contact pins 15*a* are electrically connected with one another. Correspondingly, the outer contact pins 15 are electrically connected with one another. Upon placing the top part 24 on top and connecting it by screwing to the bottom part 14, the central contact pins 15*a* penetrate into the approximately parallel extending shaped cables 3*a*, 3*b* and provide electrical contact with the strand 6 neighboring the lateral leg 26. As a result of the electrical connection of the contact pins 15*a* with one another, the strands 6 of the two shaped cables 3*a* and 3*b* are thus electrically connected with one another with correct terminal orientation. Correspondingly, the contact pins 15 electrically connect the second strands 5 with correct terminal orientation.

Figure 6:
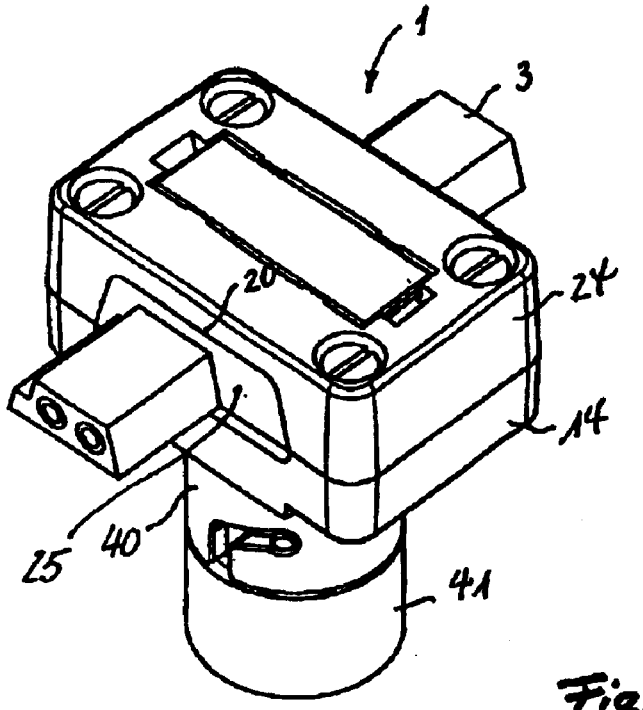
FIG. 6 is a perspective view of a contact clip with a plug connection.
Figure 7:
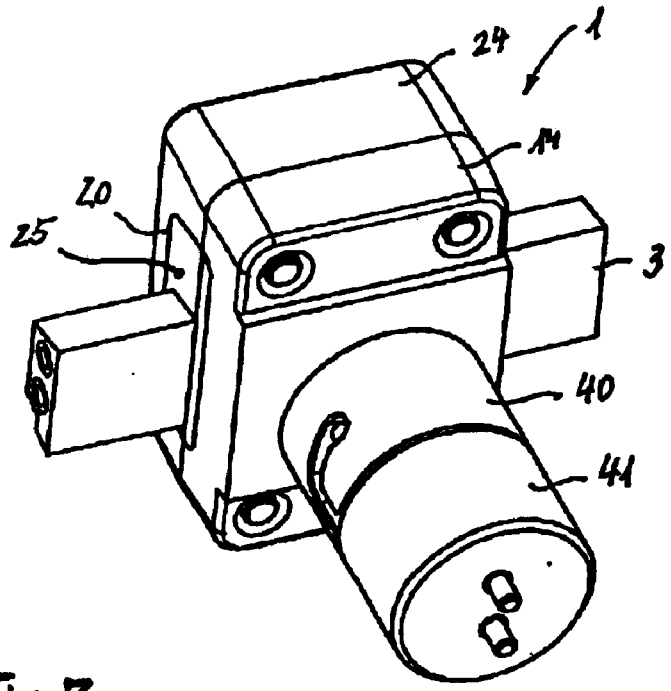
FIG. 7 is a perspective view of a contact clip according to FIG. 6 with a plug element.

The contact clip according to the invention also enables the arrangement of plug contact, a control light, or similar devices directly on the shaped cable 3. In this connection, a plug socket 40 is connected to the bottom part 14 provided with the contact pins; it can be engaged by a corresponding plug contact. In the embodiment of FIGS. 6 and 7, securing of the plug contact 41 in the plug socket 40 is provided in the form of a bayonet closure. Of course, it is also possible to employ screw connections with seals and the like in order to fulfill the corresponding safety classes.

In order to prevent moisture, solvents or the like from penetrating into the contact area, it is provided according to the invention that for the position-correct alignment of the shaped cable 3 in the receptacle 20 the fitting member 25 to be inserted is embodied as a seal. Preferably, the seal 25 surrounds the shaped cable 3 completely so that the shaped cable 3, as shown in FIGS. 6 and 7, is received completely in the coding plate comprised of a soft sealing material. The fitting member 25 thus fulfills a double function, i.e., that of a coding plate and that of a seal.

While specific embodiments of the invention have been shown and described in detail to illustrate the inventive principles, it will be understood that the invention may be embodied otherwise without departing from such principles.

What is claimed is:

1. A contact clip for an insulated, multi-strand electric cable, the contact clip comprising:

a first clip part (24) and a second clip part (14) engaging one another, wherein the first clip part (24) has a receptacle (20) for a position-correct placement of an electric cable (3, 3*a*, 3*b*) and the second clip part (14) has contact pins (15, 15*a*) assigned to a strand (5, 6) of the electric cable (3), respectively;

wherein the contact pins (15, 15*a*) in a mounted state of the first and second clip parts (14, 24) pierce an insulation of the electric cable and are positioned electrically contacting within the strand of the cable (3), respectively;

wherein the contact pins (15, 15*a*) are positioned transversely to a longitudinal direction (18) of the cable (3) adjacent to and at a spacing (z) from one another which spacing (z) corresponds approximately to a spacing (a) of the strands (5, 6), wherein the receptacle (20) is configured to be wider than the cable (3) in a direction transversely to the longitudinal direction (18) of the cable (3);

a fitting member (25) configured to be inserted into the receptacle (20) for determining a lateral position of the cable (3) in the receptacle (20);

wherein a first one of the contact pins (15), depending on the lateral position of the cable (3) within the receptacle (20), either engages one of the strands (5, 6) of the cable (3) or engages the fitting member (25).

2. The contact clip according to claim 1, wherein a second one of the contact pins is a central contact pin (15*a*) positioned in a plane (23) extending in the longitudinal direction (18) of the cable (3), wherein the plane divides the receptacle (20) in the longitudinal direction (18) of the cable (3) approximately symmetrically.

3. The contact clip according to claim 2, wherein the cable (3) is a two-strand cable and wherein, in addition to the first and second contact pins, a third contact pin (15) is provided, wherein the third contact pin (15), depending on the lateral position of the cable (3) within the receptacle (20), either engages one of the strands (5, 6) of the cable (3) or engages the fitting member (25).

4. The contact clip according to claim 2, wherein the cable (3) in a first position rests against a first lateral edge (27) of the receptacle (20) and in a second position rests against a second lateral edge (37) of the receptacle (20).

5. The contact clip according to claim 4, wherein the first and second positions are rotated by 180 degrees relative to one another about the central contact pin (15*a*).

6. The contact clip according to claim 2, wherein the contact pins (15, 15*a*) are contact blades (16) having a cutting blade (17), respectively, extending in a longitudinal direction (18) of the cable (3).

7. The contact clip according to claim 2, wherein the contact pins (15) positioned outwardly relative to the central contact pin (15*a*) are connected electrically with one another.

8. The contact clip according to claim 1, wherein the fitting member (25) is a seal.

9. The contact clip according to claim 8, wherein the fitting member (25) surrounds the cable (3).

10. The contact clip according to claim 1, wherein the cable (3) extends through the contact clip (1).

11. The contact clip according to claim 1, wherein the second clip part (14) comprises a plug connector (40).

* * * * *